US006749362B1

(12) United States Patent
Eichenberg

(10) Patent No.: US 6,749,362 B1
(45) Date of Patent: Jun. 15, 2004

(54) FOLDING MOTOR VEHICLE IMMOBILIZER AND CHASE INHIBITOR

(76) Inventor: Robert J. Eichenberg, No. 1 Collins Island, Newport Beach, CA (US) 92662

( * ) Notice: Subject to any disclaimer, the term of this patent is extended or adjusted under 35 U.S.C. 154(b) by 0 days.

(21) Appl. No.: 10/302,190

(22) Filed: Nov. 25, 2002

(51) Int. Cl.[7] ..... E01F 13/00; E05B 73/00
(52) U.S. Cl. ..... 404/6; 70/19
(58) Field of Search ..... 404/6–9; 70/19, 70/225, 226

(56) References Cited

U.S. PATENT DOCUMENTS

| | | | | | |
|---|---|---|---|---|---|
| 4,382,714 | A | * | 5/1983 | Hutchison | 404/6 |
| 4,723,426 | A | * | 2/1988 | Beaudoin | 70/14 |
| 4,804,070 | A | * | 2/1989 | Bohler | 188/32 |
| 4,854,144 | A | * | 8/1989 | Davis | 70/226 |
| 5,247,815 | A | * | 9/1993 | Caldwell | 70/19 |
| 6,116,062 | A | * | 9/2000 | Markegard et al. | 70/19 |

* cited by examiner

*Primary Examiner*—Thomas B. Will
*Assistant Examiner*—Raymond W Addie
(74) *Attorney, Agent, or Firm*—Morland C. Fischer

(57) ABSTRACT

A folding motor vehicle immobilizer and chase inhibitor to surround both the front and rear of the tire of a motor vehicle that has been stopped for investigation by law enforcement officers to prevent the vehicle and its operator from fleeing the scene of the stop so as to avoid the risks inherent with a high speed chase. The chase inhibitor includes a frontal member that is located against the outside of the tire to be surrounded and a pair of outwardly projecting spike supports that are pivotally connected to opposite ends of the frontal member. Each of the spike supports carries a set of sharp hollow spikes that are aimed at and adapted to puncture and deflate the tire should the vehicle drive off in either the forward or the reverse direction. The spike supports are rotatable from an unfolded configuration projecting from the frontal member and disposed in parallel alignment with each other during deployment to a folded configuration disposed opposite the frontal member in axial alignment with each other to establish a compact assembly suitable for transport and storage.

12 Claims, 3 Drawing Sheets

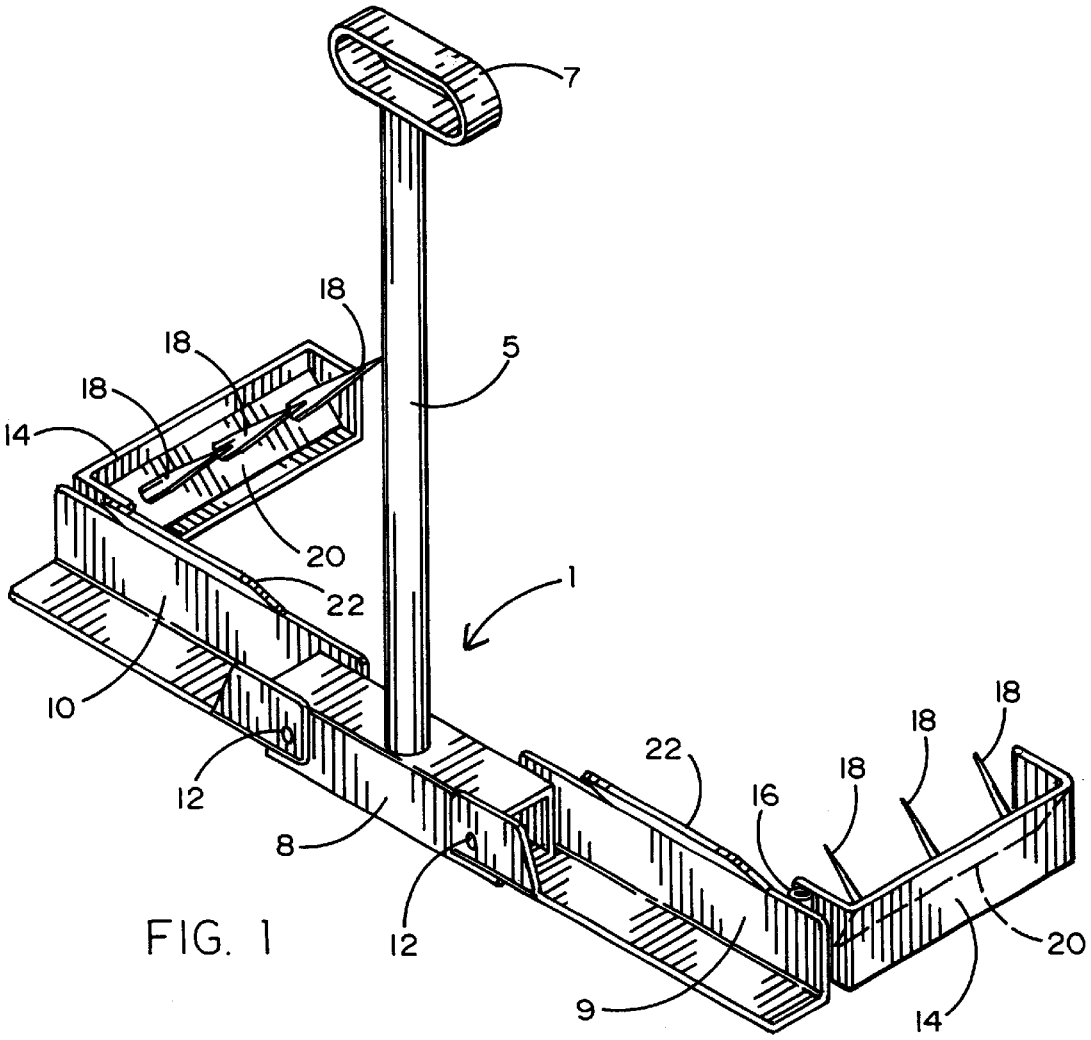
FIG. 1
FIG. 2
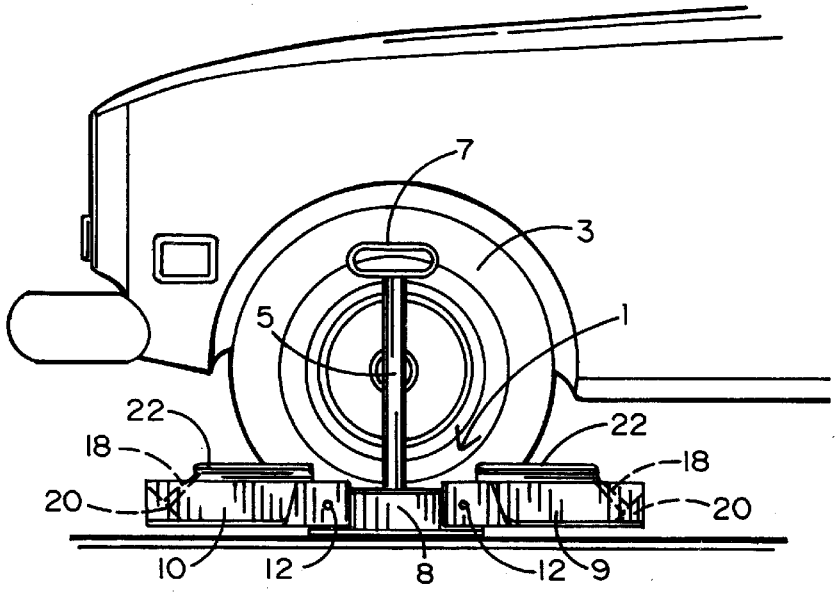

FOLDING MOTOR VEHICLE IMMOBILIZER AND CHASE INHIBITOR

BACKGROUND OF THE INVENTION

1. Field of the Invention

This invention relates to a motor vehicle immobilizer and chase inhibitor to surround both the front and rear of a tire of a motor vehicle that has been stopped by law enforcement officers to prevent the vehicle from driving away from the scene without suffering damage (i.e. puncture wounds) to the tire. The motor vehicle immobilizer is adapted to be rotated from an unfolded configuration suitable for deployment in surrounding relationship with the tire to a compact folded configuration suitable for storage.

2. Background Art

From time-to-time, it becomes necessary for law enforcement officers to stop a motor vehicle for the purpose of inspecting the vehicle and/or investigating the operator. Once the investigation has been completed without incident, the vehicle and its operator are allowed to drive away from the scene of the stop. However, on certain occasions, a suspect wishing to avoid capture or the inspection of his vehicle may flee the scene of the stop prior to completion of the investigation. In this case, the fleeing vehicle will be pursued, usually at high speed, by one or more law enforcement vehicles until the suspect is caught. As a consequence of this high speed chase, often covering long distances, the law enforcement officers, innocent motorists traveling on the roadway, and even the suspect will all be susceptible to the risk of injury to themselves and their property.

To prevent a fleeing suspect and his vehicle from escaping, vehicle immobilizer devices have been proposed by which to inflict damage to a tire of the vehicle so as to cause the tire to deflate and thereby limit the ability of the suspect to evade capture. Such vehicle immobilizer devices are typically spike strips which include a set of spikes to be placed across a roadway and aimed at and adapted to puncture a tire of an oncoming vehicle. However, the conventional vehicle immobilizer devices are characterized by several shortcomings which reduce their effectiveness for preventing a vehicle from driving away from the scene of a stop. In particular, the typical vehicle immobilizer device includes a set of spikes that is positioned to engage either the front or the rear of the tire. Thus, there is nothing to prevent the vehicle from fleeing in an opposite direction, whereby to completely avoid driving over the spikes and damaging the tire. The typical vehicle immobilizer is fairly large and bulky so as to be inconvenient to transport and difficult to store in a small space prior to deployment, such as in the trunk of a law enforcement vehicle. In this same regard, when not in use, the sharp spikes associated with the vehicle immobilizer may accidentally damage government property or injure those individuals who are in charge of handling the device.

Examples of conventional motor vehicle immobilizers (e.g. spike strips) like those described above are available by referring to one or more of the following U.S. Pat. Nos.:

| | | |
|---|---|---|
| 5,322,385 | Reisman | Jun. 21, 1994 |
| 5,482,397 | Soleau | Jan. 9, 1996 |
| 5,704,445 | Jones | Jan. 6, 1998 |
| 5,775,832 | Kilgrew et al | Jul. 7, 1998 |

-continued

| | | |
|---|---|---|
| 5,820,293 | Groen et al | Oct. 13, 1998 |
| 6,155,745 | Groen et al | Dec. 5, 2000 |

SUMMARY OF THE INVENTION

In general terms, a motor vehicle immobilizer and chase inhibitor is disclosed that is capable of being moved into surrounding relationship with a tire of a motor vehicle that has been stopped for investigation by law enforcement officers to prevent the vehicle from being driven away from the stop without sustaining damage to the tire. The chase inhibitor includes a handle support channel to which a handle is attached to enable the chase inhibitor to be easily lifted and carried from place-to-place. A pair of fold-up braces are pivotally connected to respective opposite ends of the handle support channel. A first spike support is hingedly connected to one of the pair of fold-up braces, and a second spike support is hingedly connected to the other fold-up brace. Each of the first and second spike supports carries a spike strip from which a set of sharp hollow spikes projects for the purpose of damaging and deflating the tire to be surrounded by the chase inhibitor should the vehicle flee the scene of the stop without permission.

In the unfolded configuration suitable for deployment, the handle support channel and the pair of fold-up braces pivotally connected to opposite ends thereof are axially aligned with one another to be positioned adjacent to the outside of the tire to be surrounded. The first and second spike supports project outwardly from the fold-up braces so as to lie in parallel alignment with each other adjacent the front and rear of the tire. Accordingly, the sets of hollow spikes that are carried by the spike supports will be aimed at the front and rear of the tire so as to inflict a puncture wound and thereby cause the tire to deflate should the vehicle drive away from the stop in either a forward or a reverse direction. In the compact folded configuration suitable for storage, the first and second spike supports are initially rotated from their outwardly projecting position in parallel alignment with each other to a position adjacent the pair of fold-up braces so as to lie in axial alignment with each other. The pair of fold-up braces are then rotated upwardly and off the roadway from their position in axial alignment with each other at opposite ends of the handle support channel to a position alongside the handle so as to lie in parallel alignment with each other and the handle. Therefore, the size of the chase inhibitor can be reduced so as to conveniently fit within the trunk of a law enforcement vehicle to await a future deployment.

BRIEF DESCRIPTION OF THE DRAWINGS

FIG. 1 shows the motor vehicle immobilizer and chase inhibitor which forms the present invention in the unfolded configuration ready for deployment;

FIG. 2 shows the motor vehicle immobilizer and chase inhibitor of FIG. 1 deployed in surrounding relationship with a tire of a motor vehicle that is subject to a stop by law enforcement officers;

DETAILED DESCRIPTION

Figure 3:
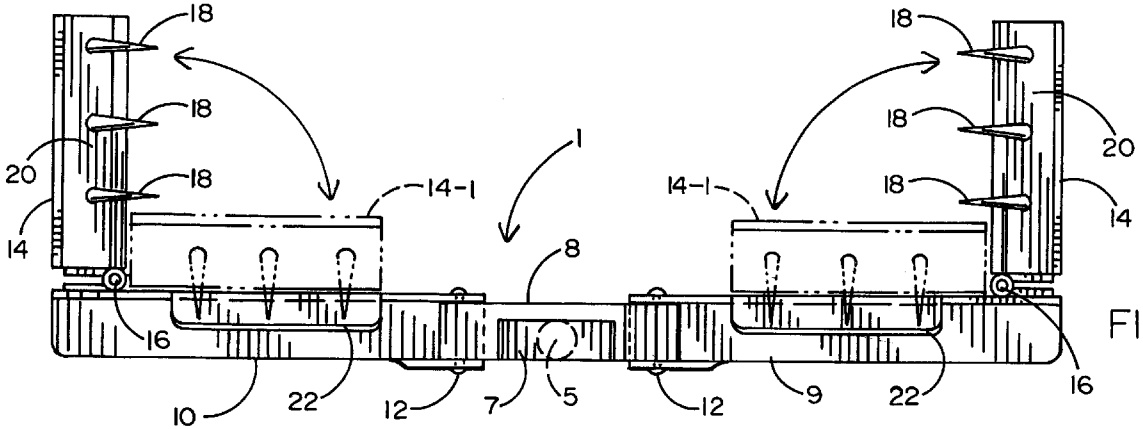
FIG. 3 is a top view of the motor vehicle immobilizer and chase inhibitor of FIG. 1.

The folding motor vehicle immobilizer and chase inhibitor 1 which forms the present invention is initially described while referring to FIGS. 1–3 of the drawings, where the chase inhibitor 1 is shown in the unfolded and ready to deploy configuration. The chase inhibitor 1 is intended to be carried by law enforcement officers to be deployed in surrounding relationship with the tires (i.e. either the front or the rear) of a motor vehicle that has been stopped for the purpose of questioning the driver and/or inspecting the vehicle. As will be described in greater detail hereinafter, the vehicle chase inhibitor 1 is adapted to prevent the stopped vehicle and its operator from fleeing the scene of the stop which could result in a potentially dangerous high speed chase with the consequence of subjecting both law enforcement officers who pursue the fleeing vehicle as well as innocent motorists to the unnecessary risks associated therewith. However, unlike other known vehicle immobilizing devices, the vehicle chase inhibitor 1 described herein is adapted to surround both the front and the rear of the tire so as to more reliably prevent a vehicle that has been stopped for investigation from driving away in either the forward or reverse direction without first sustaining damage that will be sufficient to immobilize the vehicle and prevent a prolonged and potentially high risk chase.

In the unfolded configuration of FIGS. 1–3 ready for deployment, the chase inhibitors 1 is U-shaped for surrounding the tire (designated 3 in FIG. 2) of the motor vehicle that has been stopped by law enforcement officers. The chase inhibitor 1 is transported from place-to-place by means of an elongated lifting rod 5 having a hand grip 7 at one end thereof. The opposite end of lifting rod 5 is connected to a frontal handle support channel 8. A pair of fold-up braces 9 and 10 are pivotally connected at first ends thereof to respective opposite ends of the handle support channel 8 by means of pivot pins 12. As will be explained when referring to FIGS. 5 and 6, the fold-up braces 9 and 10 are adapted to rotate around pivot pins 12 to move off the roadway and away from the handle support channel 8 so as to lie alongside the lifting rod 5 in a compact folded configuration that is suitable for storage.

The opposite ends of the pair of fold-up braces 9 and 10 are pivotally connected to respective generally L-shaped spike supports 14 by means of hinges 16 (best shown in FIG. 3). In the unfolded, U-shaped configuration, the spike supports 14 extend at an angle from the fold-up braces 9 and 10 to which they are connected. Thus, it will be appreciated that in the unfolded configuration of chase inhibitor 1, the fold-up braces 9 and 10 stretch outwardly in axial alignment from opposite ends of the handle support channel 8 and the spike supports 14 project outwardly from respective fold-up braces 9 and 10 so as to lie in perpendicular alignment with fold-up braces 9 and 10 and in parallel with each other. As will also be explained when referring to FIGS. 4–6, the spike supports 14 that are hingedly connected to respective fold-up braces 9 and 10 are adapted to be folded around hinges 16 so as to rotate towards and lie in opposing face-to-face alignment with respective ones of the fold-up braces 9 and 10 to place the chase inhibitor 1 in the compact folded configuration.

In the unfolded, ready to deploy configuration shown in FIGS. 1–3, the distance between the parallel aligned L-shaped spike supports 14 must be sufficient (e.g. about 3 feet) to enable the chase inhibitor 1 to fully surround the tire of a passenger vehicle, a small truck, an SUV, a recreational vehicle, and the like. As indicated above and as an important advantage of this invention, by properly positioning the chase inhibitor 1 to surround the tire 3 of a vehicle that has been stopped by law enforcement officers, the tire 3 will be damaged and deflated and the vehicle immobilized regardless of whether the vehicle flees the scene in a forward or a reverse direction.

More particularly, each of the L-shaped spike supports 14 carries a set of (e.g. three) hollow tire deflating spikes 18. The spikes 18 are preferably manufactured from a high tensile strength metal and include sharp tips that are capable of puncturing the tire around which the chase inhibitor 1 has been positioned. Each set of hollow spikes 18 projects about three to six inches outwardly from a spike strip 20. The spike strips 20 are affixed (e.g. welded) to the L-shaped spike supports 14 so as to extend diagonally thereacross. In this manner, the sets of spikes 18 that are carried by spike supports 14 and project outwardly from spike strips 20 will be angled about 45 degrees above the roadway to be aimed directly at the front and rear of the tire 3. However, the exact angle that is made by the sets of spikes 18 above the roadway is not to be considered a limitation of this invention, so long as the hollow spikes 18 are pointed at each of the front and rear of the tire so as to cause the tire to be punctured and quickly deflated should the vehicle drive away from the scene of the stop.

In this regard, and as is best shown in FIG. 2, the vehicle chase inhibitor 1in the unfolded and ready to deploy configuration is carried to the vehicle under investigation by a law enforcement officer and maneuvered so that one set of hollow spikes 18 carried by a first spike support 14 is aimed directly at the front of the tire 3 while the second set of hollow spikes 18 carried by the second spike support 14 is aimed directly at the rear of tire 3. It may be necessary for the law enforcement officer to apply a pushing or kicking force to the frontal handle support channel 8 to urge the fold-up braces 9 and 10 against the outside of tire 3 and thereby position the spike supports 14 which project outwardly therefrom so that the sets of hollow spikes 18 lie adjacent both the front and the rear of tire 3.

In the fully deployed configuration as just described, it will not be possible for the vehicle to flee the scene of the stop without sustaining damage to the tire 3 that is surrounded by the vehicle chase inhibitor 1. That is to say, regardless of whether the vehicle drives off in the forward or reverse direction, the tire 3 will ride over one of the sets of hollow spikes 18 that is positioned adjacent and aimed directly at the front and rear of the tire. The puncture wounds inflicted by the set of spikes 18 over which the tire 3 is driven will cause the tire to quickly deflate via the hollow interiors of the spikes, whereby to impede the escape of the driver. Thus, it will be difficult for a driver to evade eventual capture while driving with a flat tire. Moreover, there is less chance that the vehicle can maintain a high speed for very long so that there is also less chance that innocent motorists driving along the escape route will suffer injury to their vehicles or themselves as might otherwise be caused by the fleeing vehicle or the law enforcement officers giving chase thereto.

In situations where the vehicle is free to go following a routine stop and investigation by law enforcement officers, the vehicle chase inhibitor is removed from its surrounding relationship with the tire 3. In this case, the chase inhibitor 1 is now ready to be placed in the folded configuration suitable for storage in a manner to be described while referring to FIGS. 4–7 of the drawings.

Figure 4:
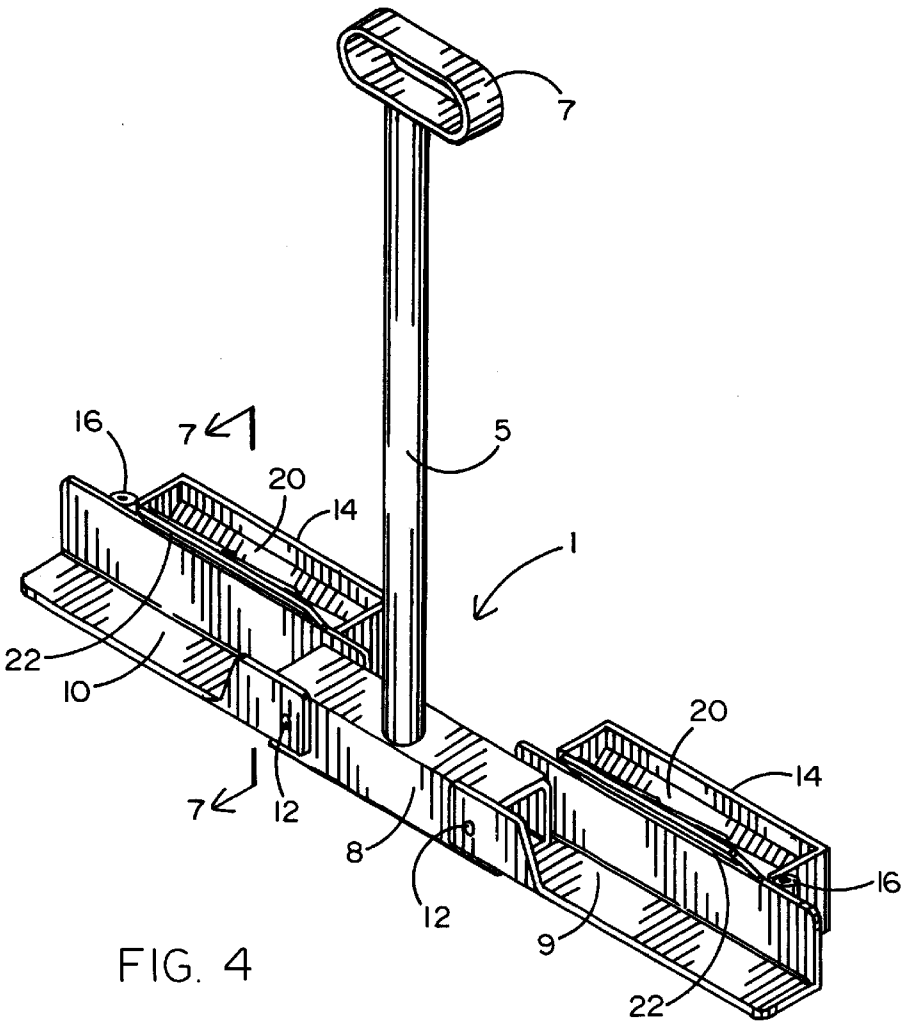
FIG. 4 shows the motor vehicle immobilizer and chase inhibitor being rotated to the folded configuration.

Referring first to FIG. 4, the spike supports 14 which carry the sets of hollow spikes 18 are rotated around hinges 16 so as to move towards the pair of fold-up braces 9 and 10. Each spike support 14 is rotated through an arc of 90 degrees from the unfolded configuration where spike supports 14 project in parallel alignment with each other as shown in FIG. 3 to the folded configuration where the spike strips (shown in phantom lines in FIG. 3 and designated 14-1) are moved opposite respective fold-up braces 9 and 10 so as to now lie in axial alignment with one another.

Figure 6:
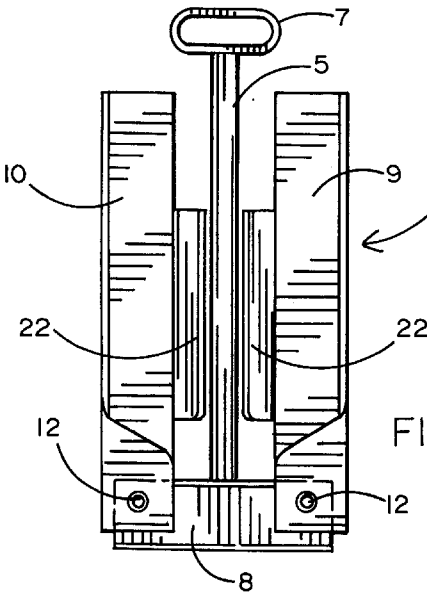
FIGS. 5 and 6 show the motor vehicle immobilizer and chase inhibitor in the compact fully folded configuration suitable for storage.
Figure 7:
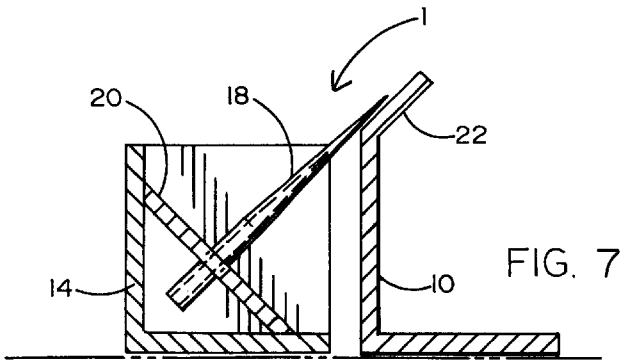
FIG. 7 is a cross-section taken along lines 7—7 of FIG. 4.
Figure 5:
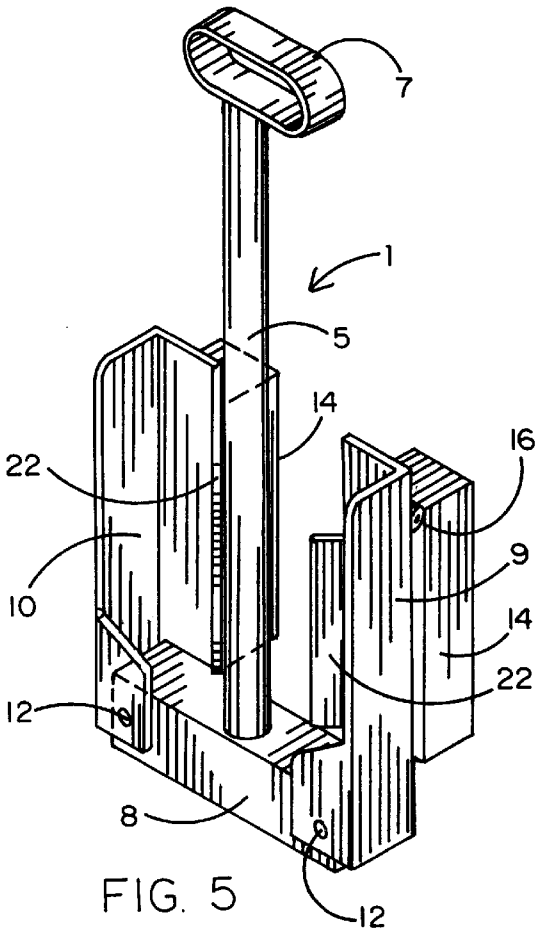

Turning to FIGS. 5 and 6, the pair of outstretched fold-up braces 9 and 10 to which the spike support 14 are hingedly connected and moved against are now rotated around pivot pins 12 so as to turn upwardly from opposite ends of the frontal handle support channel 8. Each fold-up brace 9 and 10 is rotated in combination with an opposing spike support 14 through an arc of 90 degrees from the unfolded configuration where the fold-up braces 9 and 10 are disposed in axial alignment with the handle support channel 8 to the folded configuration where the fold-up braces 9 and 10 are positioned off the roadway to lie in perpendicular alignment with the handle support channel 8 and in parallel alignment with the lifting rod 5. In the folded configuration of FIGS. 5 and 6, the vehicle chase inhibitor 1 has a compact and easy to transport configuration that is suitable to be lifted by means of hand grip 7 and lifting rod 5 for purposes of storage in the vehicle that is used by law enforcement officers until the next time that the motor vehicle immobilizer and chase inhibitor 1 will be deployed in the same manner as that described above.

To prevent damage to government property and possible injury to those law enforcement individuals who transport the motor vehicle chase inhibitor 1 in the folded condition of FIGS. 5 and 6, a spike shield 22 is affixed to the top of each of the pair of fold-up braces 9 and 10. The spike shields 22 are angled upwardly and forwardly of the fold-up braces 9 and 10 so that in the folded configuration (best shown in FIG. 7), the sharp spikes 18 which project from spike strips 20 that are carried by spike supports 14 will lie against and be shielded by the spike shields 22. Accordingly, it is preferable that the spike shields 22 extend slightly beyond the ends of the sharp tips of the spikes 18 so as to avoid an accidental contact between the spikes 18 and persons or property.

Although the motor vehicle immobilizer and chase inhibitor 1 has been described above as preventing a vehicle and its operator from fleeing the scene of a stop, it is to be understood that this invention also has application for stopping a stationary vehicle that has been or is about to be impounded from being driven away without proper authorization. In this case, locking means (e.g. a chain or the like) is required to prevent the motor vehicle immobilizer from being removed from its surrounding relationship with the tire of the vehicle in police custody.

I claim:

1. A motor vehicle immobilizer to surround and damage a tire of a stationary motor vehicle should the operator of the vehicle attempt to drive away, said motor vehicle immobilizer comprising:

a frontal member to be moved adjacent to the outside of the tire to be surrounded;

a first spike support connected to and projecting outwardly from one end of said frontal member to be located adjacent the front of the tire to be surrounded;

a second spike support connected to and projecting outwardly from the opposite end of said frontal member to be located adjacent the rear of the tire to be surrounded;

a first set of spikes carried by said first spike support and aimed at the front of the tire to be surrounded so as to puncture and deflate the tire in the event that the motor vehicle drives off in a forward direction;

a second set of spikes carried by said second spike support and aimed at the rear of the tire to be surrounded so as to puncture and deflate the tire in the event that the motor vehicle drives off in a reverse direction; and a pair of fold-up braces carrying respective ones of said first and second supports, said pair of hold-up braces being pivotally connected to opposite ends of said frontal member so as to be rotatable from an unfolded configuration lying against the roadway in axial alignment with one another to a folded configuration above the roadway in parallel alignment with one another.

2. The motor vehicle immobilizer recited in claim 1, further comprising a handle attached to the frontal member by which said immobilizer can be lifted and transported from place-to-place.

3. The motor vehicle immobilizer recited in claim 1, wherein said first spike support is pivotally connected to one of said pair of fold-up braces and said second spike support is pivotally connected to the other one of said pair of fold-up braces, each of said first and second spike supports being rotatable from the unfolded configuration projecting outwardly from said pair of fold-up braces in parallel alignment with each other to the folded configuration opposite said pair of fold-up braces in axial alignment with each other.

4. The motor vehicle immobilizer recited in claims 3, wherein said first and second spike supports are hingedly connected to said pair of fold-up braces so as to be rotatable relative thereto between the unfolded and folded configurations.

5. The motor vehicle immobilizer recited in claim 3, further comprising a spike shield connected to each of said pair of fold-up braces adjacent which said first and second sets of spikes are positioned when said first and second spike supports are rotated to the folded condition opposite said pair of fold-up braces.

6. The motor vehicle immobilizer recited in claim 1, wherein each spike of said first and second sets of spikes is hollow for causing a rapid deflation of the tire punctured thereby.

7. A motor vehicle immobilizer to surround and damage a tire of a stationary motor vehicle should the operator of the vehicle attempt to drive away, said motor vehicle immobilizer comprising:

a frontal member to be moved adjacent the outside of the tire to be surrounded;

at least one spike support pivotally connected to one end of said frontal member to be located adjacent one of the front and the rear of the tire to be surrounded, said spike support being rotatable from an unfolded configuration projecting outwardly from said frontal member to a folded configuration lying opposite said frontal member; and a set of spikes carried by said at least one spike support and aimed at the tire to be surrounded so as to puncture and deflate the tire in the event that the vehicle drives over said spike support in said unfolded configuration.

8. The motor vehicle immobilizer recited in claim 7, further comprising a handle attached to said frontal member by which said immobilizer is lifted and transported from place-to-place.

9. The motor vehicle immobilizer recited in claim 8, wherein said frontal member includes a handle support and a fold-up brace, said handle attached to said handle support and said fold-up brace pivotally connected at one end thereof to said handle support and pivotally connected at the opposite end to said at least one spike support, said fold-up brace being rotatable from the unfolded configuration lying against the roadway to the folded configuration extending above the roadway.

10. The motor vehicle immobilizer recited in claim 2, wherein each spike of said set of spikes is hollow for causing a rapid deflation of the tire punctured thereby.

11. The motor vehicle immobilizer recited in claim 7, further comprising a second spike support pivotally connected to the opposite end of said frontal member to be located adjacent the other one of the front and the rear of the tire to be surrounded, said second spike support being rotatable from the unfolded configuration to the folded configuration; and another set of spikes carried by said second spike support and aimed at the tire to be surrounded so as to puncture and deflate the tire in the event that the vehicle drives over said second spike support in said unfolded configuration.

12. A motor vehicle immobilizer to surround and damage a tire of a stationary motor vehicle should the operator of the vehicle attempt to drive away, said motor vehicle immobilizer comprising:

a side member to be located adjacent a side of the tire to be surrounded; a first folding spike support pivotally connected to said side member and having a first set of spikes to be located adjacent the front of the tire to be surrounded and a second folding spike support pivotally connected to said side member and having a second set of spikes to be located adjacent the rear of the tire to be surrounded;

each of said first and second folding spike supports being rotatable relative to said side member through an arc of 90 degrees from a first unfolded configuration at which said first and second sets of spikes are aimed to puncture and deflate the tire to be surrounded to a second folded configuration at which said first and second sets of spikes are aimed so as to avoid puncturing and deflating the tire.

* * * * *